United States Patent [19]

Black, III et al.

[11] Patent Number: 4,678,249

[45] Date of Patent: Jul. 7, 1987

[54] ELECTRICAL SWITCH HAVING FLEXIBLE PRINTED CIRCUIT CONNECTOR CABLE

[75] Inventors: Charles E. Black, III, Mount Prospect; Raymond T. Halstead, Wheeling, both of Ill.

[73] Assignee: Indak Manufacturing Corp., Northbrook, Ill.

[21] Appl. No.: 813,771

[22] Filed: Dec. 27, 1985

[51] Int. Cl.[4] ..... H01R 4/48

[52] U.S. Cl. ..... 439/77; 200/243; 200/292; 411/544; 439/733; 439/751

[58] Field of Search ..... 339/17 R, 17 E, 17 C, 339/17 D, 17 F, 214 R, 214 C, 214 S, 219 R, 220 R, 220 C, 263 R; 200/292, 159 A, 243, 275; 361/398, 414; 411/544

[56] References Cited

U.S. PATENT DOCUMENTS

| | | | |
|---|---|---|---|
| 259,665 | 6/1882 | Broomall et al. | 411/544 |
| T861,012 | 4/1969 | Mendola | 339/17 R |
| 3,845,256 | 10/1974 | Edwards | 339/17 C |
| 4,072,377 | 2/1978 | Van de Loo et al. | 339/220 R |
| 4,263,485 | 4/1981 | Corwin | 200/292 |
| 4,496,813 | 1/1985 | Fukushima | 200/292 |

FOREIGN PATENT DOCUMENTS

| | | | |
|---|---|---|---|
| 1201350 | 7/1959 | France | 411/544 |
| 1239764 | 7/1971 | United Kingdom | 339/17 D |

OTHER PUBLICATIONS

IBM Bulletin, Hill, vol. 27, No. 4B, p. 2496, 9-1984.

*Primary Examiner*—Neil Abrams

*Attorney, Agent, or Firm*—Burmeister, York, Palmatier, Hamby & Jones

[57] ABSTRACT

Compressible metal spring washers are mounted around the shank portions of terminal rivets and are clamped against thin conductor laminae of a flexible printed circuit having a resilient resinous plastic base lamina, clamped by the rivets against a relatively rigid plastic terminal supporting member. Each washer has a central dished portion, a reversely dished peripheral portion, and a smoothly rounded annular bulging portion therebetween for engaging one of the thin conductor laminae, without cutting into the laminae. The spring washers obviate any looseness of the terminal rivets due to dimensional variations, shrinkage with age, and temperature variations.

3 Claims, 22 Drawing Figures

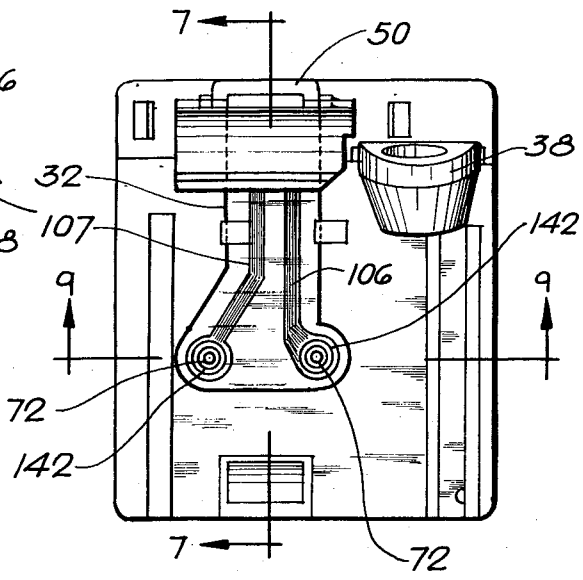
FIG. 3
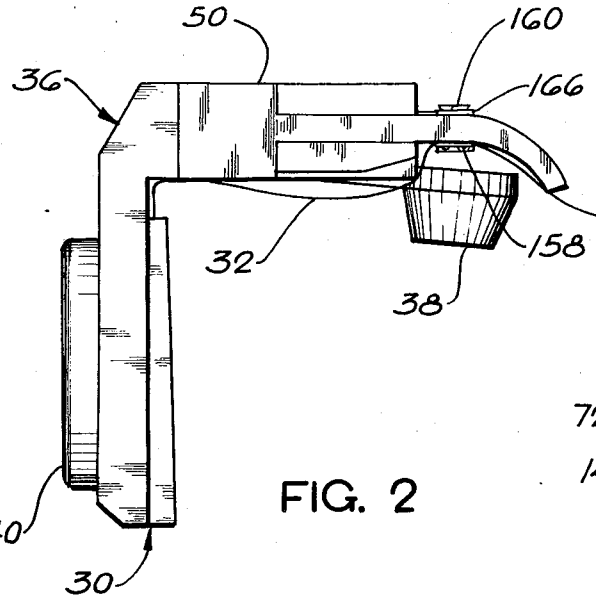
FIG. 2
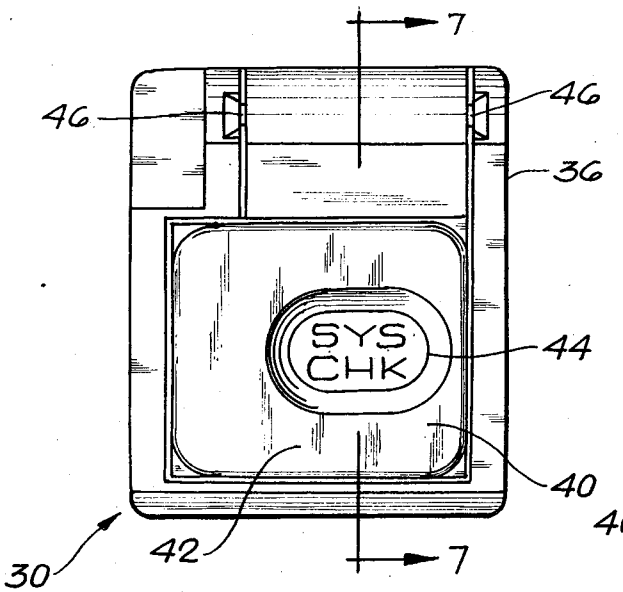
FIG. 1
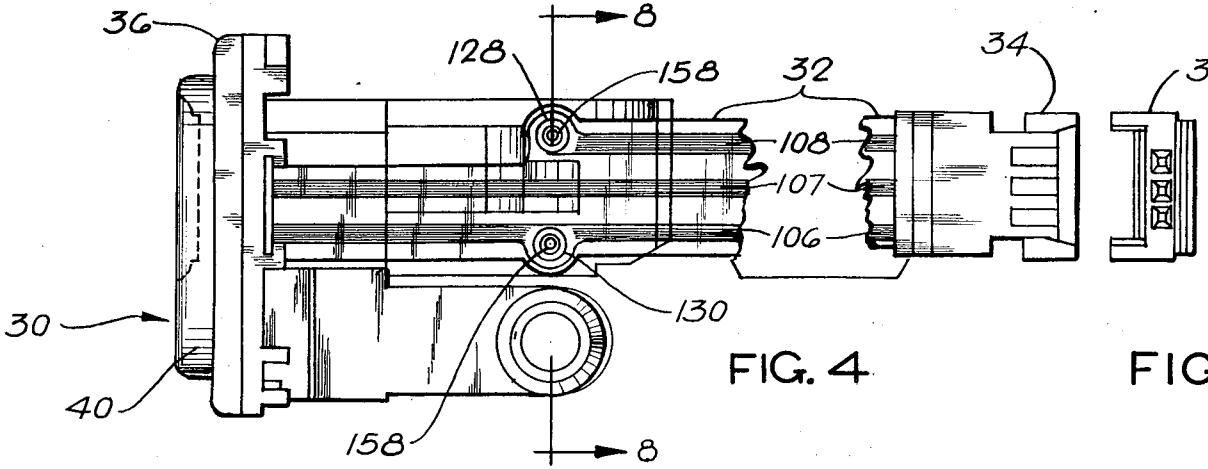
FIG. 4
FIG. 5

ELECTRICAL SWITCH HAVING FLEXIBLE PRINTED CIRCUIT CONNECTOR CABLE

FIELD OF THE INVENTION

This invention relates to a new and improved electrical switch having a connector cable in the form of a flexible printed circuit. The switch is intended primarily for automotive use, on automobiles, trucks and other vehicles, but will also find other applications.

BACKGROUND OF THE INVENTION

In certain types of automotive switches, the internal contacts and other components are connected to the terminals of a plug or receptacle, mounted on the casing of the switch and adapted to mate with a compatible receptacle or plug, to which the wires of a cable or a wiring harness are connected.

In other types of automotive switches, the contacts and other components are connected directly to wires or conductors of a cable or a wiring harness.

SUMMARY OF THE INVENTION

One general object of the present invention is to provide a new and improved electrical switch or the like, in which the contacts and other terminals of the switch are connected directly to the conductors of a connector cable in the form of a flexible printed circuit. In the flexible printed circuit, the conductors are in the form of flexible metal strips or laminae, formed by circuit printing techniques, and securely laminated to a flexible base lamina, made of an electrically insulating material, such as a thin flexible resinous plastic sheet or film material.

A further object of the present invention is to provide a new and improved switch in which the contacts and other terminals of the switch are connected directly to the conductors of the flexible printed circuit, in such a manner as to establish and maintain tight connections, so that looseness is obviated, both initially and during the long service life of the switch.

A more specific object is to obviate any looseness which might otherwise tend to develop, due to differential shrinkage or deformation of the flexible printed circuit or the switch casing, or both, with age, temperature variation or the like.

To achieve these and other objectives, the present invention may provide an electrical switch or the like, comprising an electricity insulating terminal supporting member having first and ssecond opposite sides, such member having a substantial rigidity and being made of a resinous plastic material, such member having an opening therein extending between such opposite sides, an electrically conductive terminal rivet having a head portion on the first side of such terminal supporting member, such rivet having a shank portion connected to such head portion and extending through the opening in such member, a flexible laminated printed circuit having an aperture therein for receiving the shank portion of such rivet, such flexible printed circuit having an electrically insulating base lamina and an electrical conductor lamina securely laminated to such base lamina, such base lamina being made of a thin flexible resilient electrically insulating resinous plastic material, such electrical conductor lamina being made of thin flexible metal, such base lamina engaging the second side of such insulating terminal supporting member, and a compressible annular spring washer mounted on such shank portion of such rivet and engaging such electrical conductor lamina, such rivet having an upset end portion on such shank portion for securely engaging and retaining while also compressing such compressible spring washer, such washer being made of thin flexible resilient metal and being formed with a central annular dished portion, a reversely dished peripheral annular portion, and a smoothly rounded annular bulging portion therebetween for engaging such conductor lamina without any tendancy to cut into such conductor lamina, such washer being resiliently compressible to obviate any looseness of the terminal rivet despite any minor dimensional variations and despite any shrinkage of the flexible printed circuit and the terminal supporting member due to such factors as aging and temperature variations.

The base lamina of the flexible printed circuit may be made of a thin flexible resilient electrically insulating material, such as a polyester resinous plastic material, or some other suitable plastic material. The electrical conductor lamina of the flexible printed circuit is made of thin flexible metal, such as copper, or some other electrically conductive material, such as a silver-bearing graphite ink, securely laminated to the base lamina. The conductor lamina may be formed by any suitable circuit printing techniques.

The switch or the like may include two or more terminal rivets, which may be connected to a plurality of different conductor elements of the flexible printed circuit. The conductor elements may be formed as separate metal strips, laminated to the base lamina of the flexible printed circuit. Separate apertures may be formed in the flexible printed circuit for receiving the separate terminal rivets. Each aperture extends through the base lamina and one of the conductor laminae. Separate compressible spring washers are employed on the separate terminal rivets, between the separate conductor laminae and the upset end portions of the rivets.

Preferably, the flexible printed circuit also includes a thin overlay lamina which covers and protects the conductor laminae. The overlay lamina is formed with openings to expose the conductor laminae at the locations where the conductor laminae are to be connected to the terminal rivets.

In the electrical switch or the like, an electrically conductive contactor may be movable selectively into and out of engagement with the head portion of the terminal rivet. The contactor may be made of a highly conductive metal and may be movable into and out of engagement with at least two of the terminal rivet heads, so as to afford a bridging circuit connection therebetween. Thus, the terminal rivet heads may be employed directly as switch contacts.

In other situations, the terminal rivets may be connected to thin electrical conductors which may be retained between the rivet heads and the terminal supporting member. The electrical conductors may be apertured to receive the shank portions of the rivets. Various electrical components may be connected to the thin electrical conductors. Thus, for example, the two terminals of a lamp may be engaged with portions of the electrical conductors, so that the lamp may be energized by an electrical current supplied to the conductors by way of the terminal rivets and the flexible printed circuit. The lamp may be employed to illuminate a portion of the electrical switch.

The flexible printed circuit may be connected to both the switch contact rivets and the terminal rivets for use in energizing the lamp. Separate compressible spring washers are employed on all of the rivets to obviate any looseness between the rivets and the conductor laminae of the flexible printed circuit.

BRIEF DESCRIPTION OF THE DRAWINGS

Further objects, advantages and features of the present invention will appear from the following description, taken with the accompanying drawings, in which:

FIG. 1 is a front view of an electrical switch to be described as an illustrative embodiment of the present invention.

FIGS. 2 and 3 are side and rear elevational views of the switch of FIG. 1.

FIG. 4 is a bottom view of such switch.

FIG. 5 is an end view of an electrical connector or plug, connected to the end of the printed circuit cable for the switch, as shown in FIG. 4.

DETAILED DESCRIPTION OF AN ILLUSTRATIVE EMBODIMENT

Figure 7:
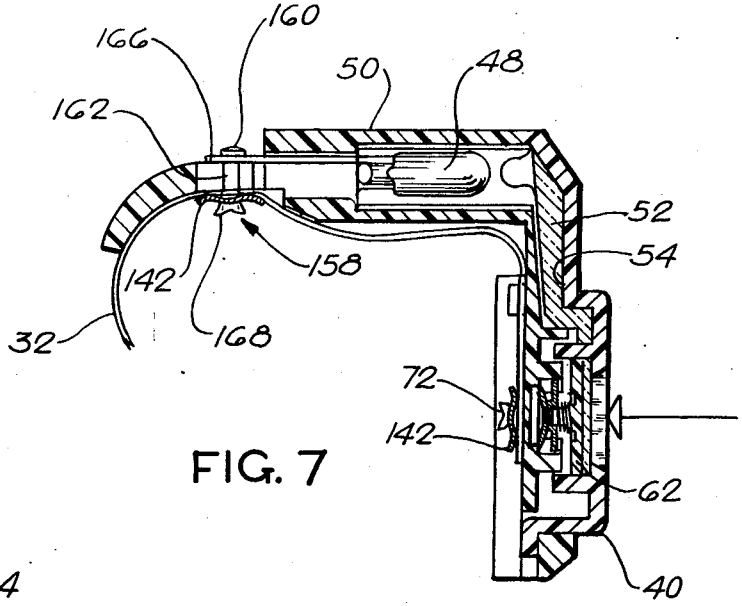
FIG. 7 is a vertical section, taken through the switch, generally along the line 7—7, shown in both FIG. 1 and FIG. 3.

As just indicatcd, the drawings show an electrical switch 30, constituting an illustrative embodiment of the present invention. The switch 30 is shown generally in FIGS. 1–9. Component parts and details of the switch 30 are shown in FIGS. 10–22. The switch 30 is provided with a connector cable in the form of a flexible printed circuit 32. The free end of the flexible printed circuit 32 is provided with an electrical plug or connector 34, for connecting the switch 30 into an electrical system or device.

The electrical switch 30 has a casing or body 36, adapted to be mounted on an instrument panel or the like. The casing 36 includes a mounting bracket 38. The switch 30 is intended primarily for automotive service, on automobiles, trucks and other vehicles, but the switch will find other applications.

The electrical switch 30 has a movable operating member 40 which is swingably mounted on the casing 36 and is adapted to be pushed rearwardly, to actuate the switch. The operating member or arm 40 is spring returned forwardly, when it is not pushed rearwardly. Thus, the operating arm 40 may also be referred to as a push button.

The operating arm 40 has a front face 42 formed with a window 44 in which an identifying legend appears. In this case, the Iegend reads "SYS CHK" meaning systems check. Thus, the switch 30 may be employed to initiate the operation of an electronic circuit which checks the status of various operating systems on the vehicle. The switch 30 will find many other applications.

The operating arm or push button 40 of the switch 30 is swingable about a pair of pivots 46, located near the upper end of the arm 40, and also near the upper end of the casing 36. The window 44 is located near the lower end of the operating arm 40.

Figure 6:
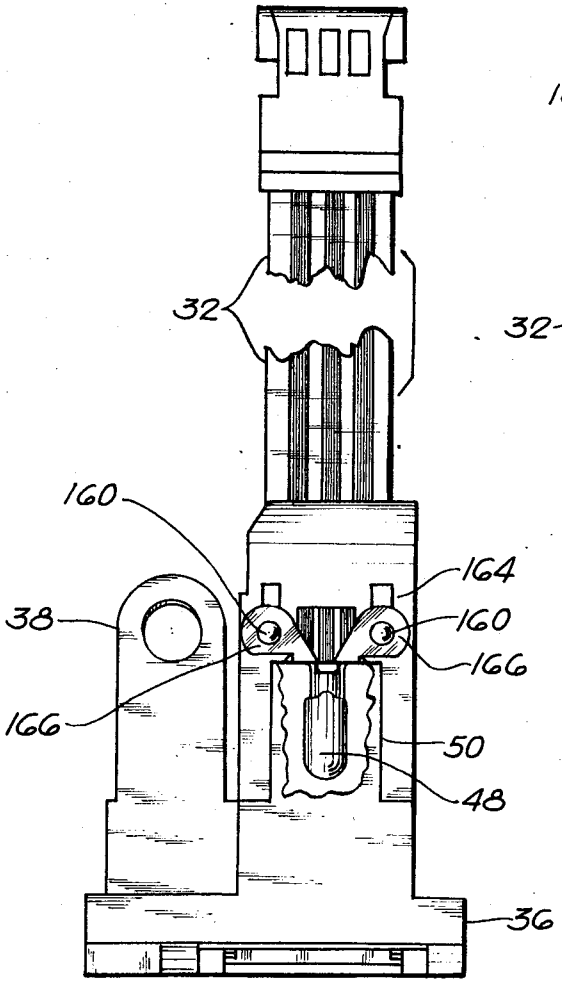
FIG. 6 is a top view of the switch of FIG. 1, with a portion of the casing broken away to illustrate the position of a lamp for illuminating the switch.

The window 44 is illuminated by an electrical lamp 48, mounted in a lamp housing 50, constituting a portion of the casing 36 and projecting rearwardly at the upper end of the casing, as shown in FIGS. 6 and 7. The light is transmitted from the lamp 48 to the window 44 by a light-transmitting lens member 52, preferably made of a light-transmitting resinous plastic material. As shown in FIG. 7, the lens member 52 is mounted in the swingable operating arm 40, the rear portion of which is formed with a recess or cavity 54 for receiving the lens member 52. It will be seen from FIGS. 7 and 17 that the lens member 52 has a complex zig-zag shape and is formed with three successive reflecting surfaces 55, 56 and 58, for reflecting the light from the lamp 48, opposite the upper end of the lens member 52, to the window 44, opposite the lower end portion of the lens member 52. The identifying legend may be applied to a forwardly facing zone or surface 60 on the lower end portion of the lens member 52. The zone 60 is opposite the window 44 and is the same in shape. The zone 60 may be slightly depressed or hollowed out.

The lens member 52 is held in place within the operating arm 40 by a carriage 62 seated to the rear of the lower portion of the lens member 52, and secured within a cavity 64 in the lower portion of the operating arm 40. The cavity 64 constitutes the lower portion of the previously mentioned cavity 54. The carriage 62 is suitably secured in the cavity 64, as by heat sealing or ultrasonic welding, for example.

The carriage 62 is provided with a central, rearwardly projecting pin or peg 66, adapted to push a contactor 68 rearwardly, into engagement with head portions 70 of two terminal rivets 72. Thus, the rivet heads 70 serve as fixed contacts of the electrical switch 30. The rivets 72 have shank portions 74, connected to the head portions 70, and extending through openings 76 in an electrically insulating terminal-supporting member or board 78, formed as a portion of the casing 36. The member 78 is preferably made of a suitable resinous plastic material which can be intricately molded and is resistant to heat, as well as being a good electrical insulator.

Figure 15:
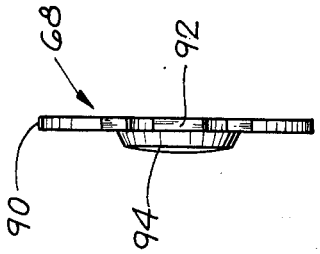
FIG. 15 is a side elevational view of the contactor.
Figure 19:
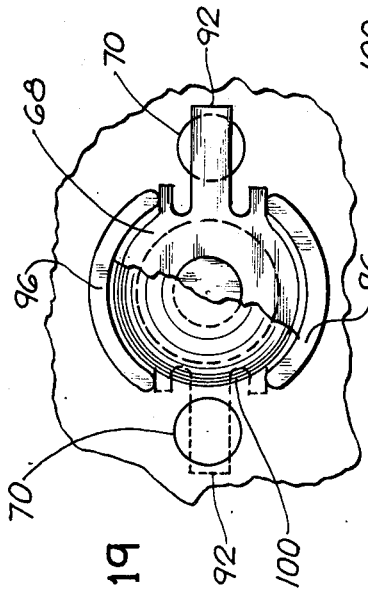
FIG. 19 is a fragmentary enlarged elevation, taken generally as indicated by the line 19—19 in FIG. 18.
Figure 14:
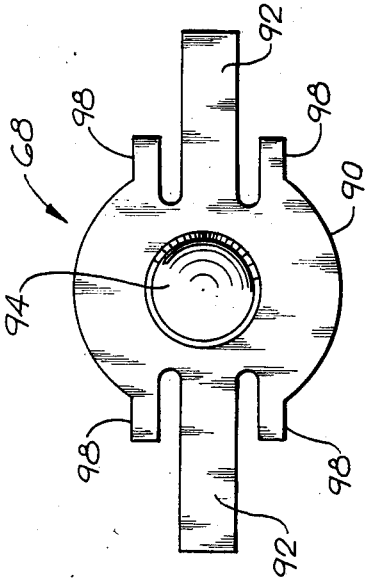
FIG. 14 is an enlarged elevational view of a contactor employed as a component in the switch.
Figure 16:
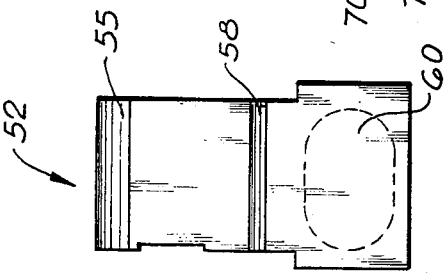
FIGS. 16 and 17 are front and side elevational views of a light-transmitting lens employed as a component in the switch.
Figure 17:
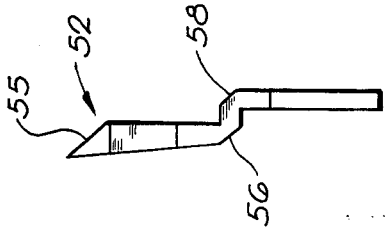
Figure 13:
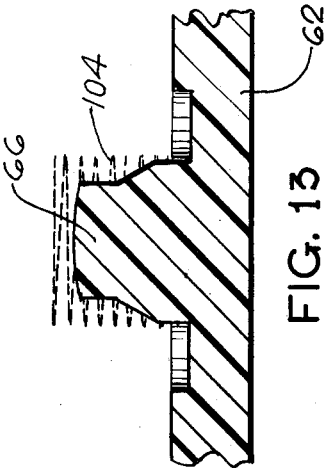
FIG. 13 is an enlarged fragmentary horizontal section, showing the mounting of a coil spring on the carriage of FIGS. 11 and 12.
Figure 11:
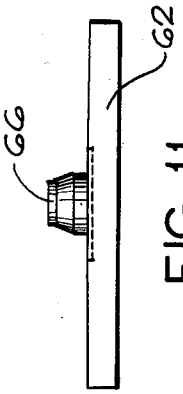
FIGS. 11 and 12 are enlarged plan and elevational views of a carriage, employed as a component in the switch.
Figure 12:
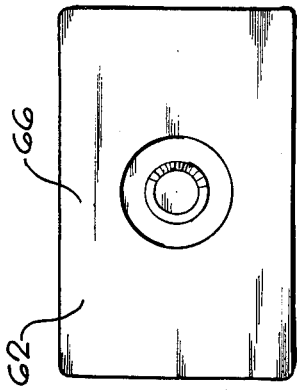

As shown to best advantage in FIGS. 14 and 15, the contactor 68 is in the form of a thin metal plate having a central disc-like portion 90, from which a pair of flexible, resilient arms 92 extend in opposite directions. The disc portion 90 is centrally dished to form a rearwardly projecting boss 94.

The contactor 68 is located, oriented and guided by a pair of curved retaining walls or flanges 96, projecting rearwardly from the supporting member or wall 78. The contactor 68 has tabs 98 which project into the spaces between the curved retaining walls 96, so that the contactor 68 will be properly oriented, with the arms 92 opposite the rivet heads or contacts 70.

Initially, the rearward movement of the contactor 68 is resisted by a spring 100 which is disc-shaped and is of the type often referred to as a tactile disc spring. As shown, the spring 100 is in the form of a rearwardly convex disc, made of thin flexible resilient metal, such as spring steel. The disc spring 100 is located and retained by the curved retaining walls 96. It will be seen from FIG. 18 that the disc spring 100 is engaged by the contactor 68 and is positioned between the contactor and the supporting member or wall 78. A circular recess 102 is formed in the rear side of the supporting wall 78, opposite the spring disc 100.

When the contactor 68 is pushed rearwardly by the pin 66 on the carriage 62, the rearwardly convex spring disc 100 is compressed, so that the spring disc initially resists the rearward movement of the contactor 68. However, as the disc 100 is flattened out, it abruptly snaps into a rearwardly concave, forwardly convex shape, so that the contactor 68 abruptly moves rearwardly, to bring the contact arms 92 into firm engagement with the contact rivet heads 70. When the spring disc 100 is snapped into its forwardly convex shape, the central portion of the disc 100 projects into the recess 102.

Figure 18:
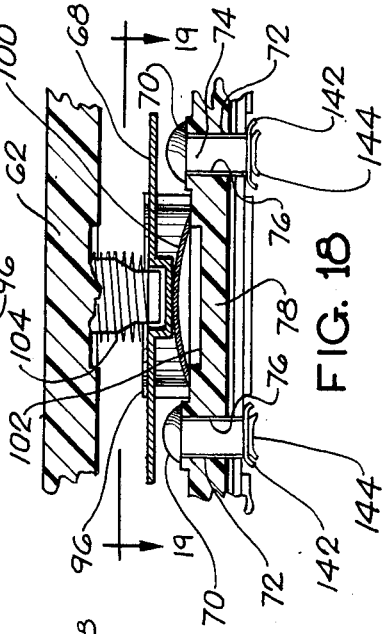
FIG. 18 is a fragmentary enlarged section, corresponding generally to a portion of FIG. 9.

It will be understood that the carriage 62 and the contactor 68 are moved rearwardly by the manual exertion of force on the swingable operating arm 40, which can be pushed rearwardly by one finger of the operator. When the operator allows the arm 40 to return forwardly, by releasing the operating force, the arm 40 is spring returned forwardly by the disc spring 100, which abruptly snaps back into its rearwardly convex shape, as shown in FIG. 18. Thus, the contact arms 92 of the contactor 68 are abruptly moved away from the contact rivet heads 70.

A coil spring 104 is preferably mounted around the pin 66 and is compressed between the carriage 62 and the contactor 68, to take up any slack between the pin 66 and the contactor 68, so as to prevent any rattling of the operating arm 40.

Figure 22:
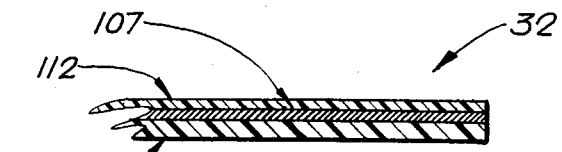
FIG. 22 is a diagrammatic, enlarged, fragmentary section, taken through the flexible printed circuit, generally along the line 22—22 in FIG. 10.
Figure 10:
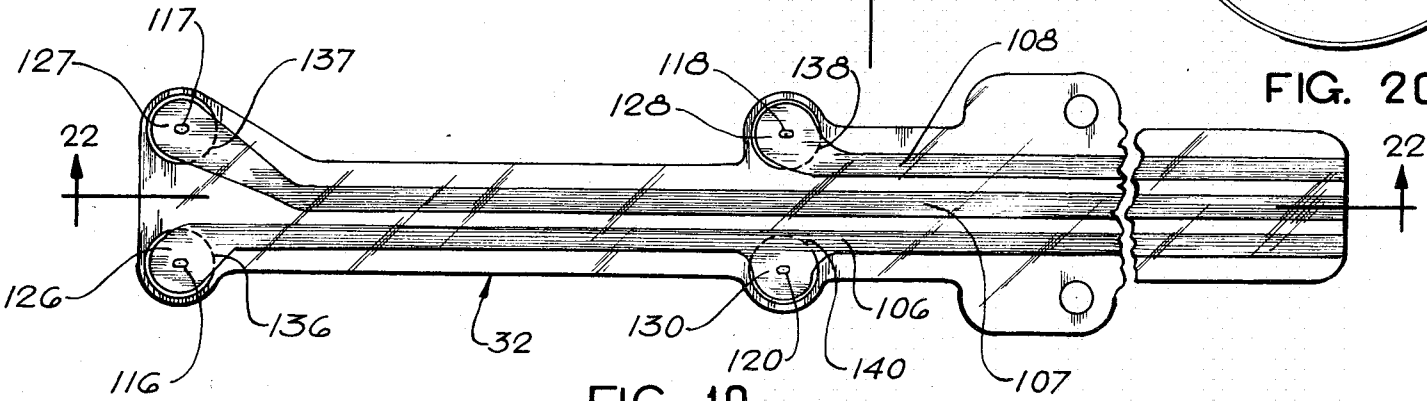
FIG. 10 is a fragmentary plan view, showing the flexible printed circuit, employed as a connector cable for the switch.
Figure 8:
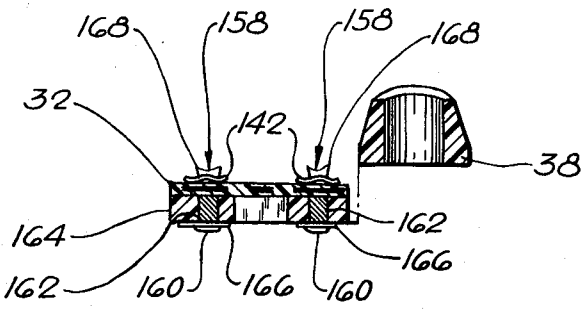
FIG. 8 is a fragmentary vertical section, taken generally along the line 8—8 in FIG. 4.

The terminal rivets 72 are connected directly to the flexible printed circuit 32, which serves as the connector cable for the electrical switch 30. As shown in FIGS. 10 and 22, the flexible printed circuit 32 comprises three thin conductor strips or laminae 106, 107 and 108, made of copper or the like, and securely laminated to a base lamina 110, made of a thin flexible resilient electrically insulating material, preferably a thin resinous plastic film or sheet, made of polyester or some other suitable resinous plastic material. As shown in FIG. 10, the flexible printed circuit 32 is generally in the form of an elongated strip. The conductor strips or laminae 106, 107 and 108 may be formed into the desired shapes by any suitable circuit printing techniques. Preferably, an overlay lamina 112 is employed to cover the conductor laminae 106, 107 and 108, except where they are to be engaged to establish electrical contact therewith. The overlay lamina 112 is securely laminated to the conductor laminae 106, 107 and 108, and also to the base lamina 110, where it is exposed. The overlay lamina 112 is also preferably made of polyester film, or any other suitable resinous plastic material.

The thickness of the various laminae in the flexible printed circuit 32 may be varied, but it may be helpful to set forth one set of dimensions, by way of example. Thus, in terms of decimal fractions of an inch, the thickness of the base lamina 110 may be about 0.005, while each of the conductor strips or laminae 106, 107 and 108 may also be about 0.005. The overlay lamina may be thinner, about 0.002.

The conductor strips or laminae 106 and 107 of the flexible printed circuit are connected directly to the terminal or contact rivets 72. As shown in FIG. 10, the flexible printed circuit 32 is formed with apertures 116 and 117, extending through the base lamina 110 and the conductor laminae 106 and 107, to receive the shank portions 74 of the rivets 72. The flexible printed circuit 32 is also formed with an aperture 118, extending through the base lamina 110 and the conductor strip 108. Another aperture 120 extends through the base lamina 110 and the conductor strip 106. The conductor strips 106, 107 and 108 have enlarged terminal portions 126, 127, 128 and 130 around the apertures 116, 117, 118 and 120. Still larger openings 136, 137, 138 and 140 are formed in the overlay lamina 112, to expose the enlarged portions 126, 127, 128 and 130.

To provide tight, secure connections, without any looseness, compressible spring washers 142 are mounted around the shank portions 74 of the rivets 72 and are retained and compressed against the enlarged terminal portions 126 and 127 of the conductor strips 106 and 107 by upset end portions 144 on the shank portions 74 of the rivets 72.

Figure 21:
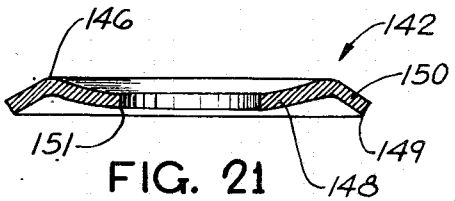
FIG. 21 is a central section taken through the spring washer of FIG. 20.
Figure 20:
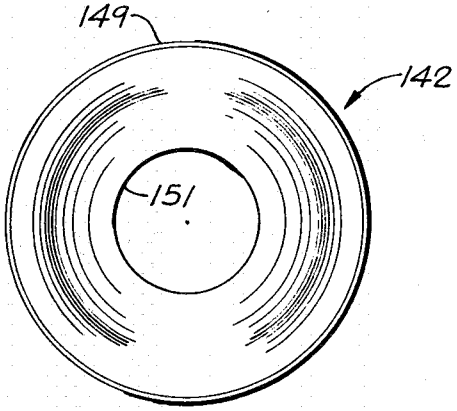
FIG. 20 is an enlarged elevational view of one of the spring washers employed in the switch.
Figure 9:
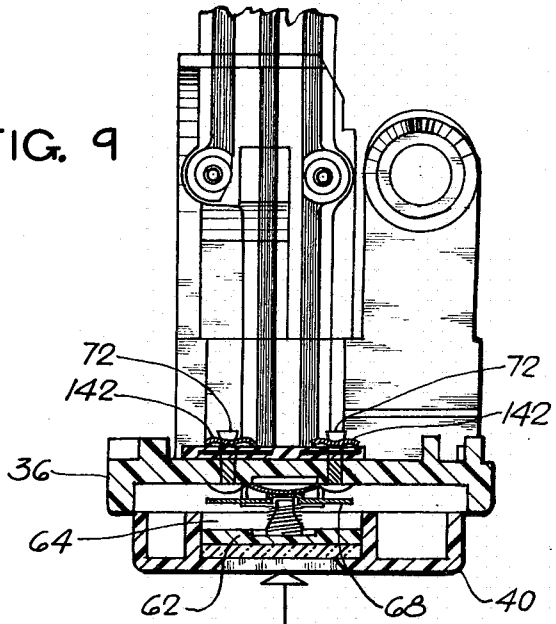
FIG. 9 is a horizontal section, taken generally along the line 9—9 in FIG. 3.

As shown in FIGS. 20 and 21, the spring washers 142 are dish shaped to make them compressible. The washers 142 are made of thin flexible resilient metal, such as cartridge brass, for example, which may be silver plated for improved electrical conductivity and low contact resistance. Each of the washers 142 has a smooth, rounded annular bulging portion 146 for engagement with one of the conductor strips or laminae 106, 107 and 108 of the flexible printed circuit 32. The annular bulging portion 146 is formed at the juncture between a central dished portion 148 and a reversely dished peripheral portion 150 of the washer 142. The reversely dished portion 150 and the orientation of the washer 142 in assembly insure contact of only the smooth annular portion 146 with the conductor laminae and prevent either the outer or inner diameter edges 149 and 151 of the washer 142 from cutting through the thin conductor laminae.

The compressible spring washers 142 insure that tight connections are formed and maintained between the rivets 72 and the conductor strips 106 and 107 of the flexible printed circuit 32. The compression of the compressible spring washers 142 obviates any looseness between the rivets 72 and the conductor strips 106 and 107, both initially and during the long service life of the electrical switch 30, despite minor dimensional variations, and despite any differential shrinkage or deformation of the flexible printed circuit 32 or the switch casing 36, or both, due to aging, temperature variations or the like.

The electrical switch 30 has two other terminal rivets 158 which are employed to energize the electrical lamp 48. The rivets 158 are connected to the enlarged conductor or terminal portions 128 and 130 on the flexible printed circuit 32, as shown in FIG. 4. The terminal rivets 158 have head portions 160 connected to shank portions 162 which extend through corresponding openings in an electrically insulating supporting member or wall 164, formed on the casing 36 toward the rear of the lamp housing 50. Again, the supporting wall 164 is preferably made of a resinous plastic material.

In this case, the shank portions 162 of the terminal rivets 158 extend through corresponding openings in thin metal conductors 166 which are clamped between the rivet heads 160 and the supporting wall 164. The thin metal conductors 166 have portions which extend into the lamp housing 50 and are employed to make electrical connections with the terminals of the lamp 48.

The shank portions 162 of the terminal rivets 158 extend through the apertures 118 and 120 in the flexible printed circuit 32. Additional compressible spring washers 142 are mounted around the shank portions 162 and are clamped against the enlarged conductor portions 128 and 130 by upset end portions 168 on the shank portions 162 of the rivets 158. The base lamina 110 of the flexible printed circuit 32 is clamped against the lower side of the supporting wall 164.

Again, the resilient clamping action of the compressible spring washers 142 insures that the rivets 158 are tightly clamped, without any looseness, both initially and throughout the long service life of the electrical switch 30. The rivet heads 160 are tightly clamped against the thin metal conductors 166, without any looseness, despite minor dimensional variations, and despite any differential shrinkage or deformation which may occur in the flexible printed circuit 32 or the switch casing 36, or both, due to aging, temperature variations, or the like.

We claim:

1. An electrical switch or the like, comprising an electrically insulating terminal supporting member having first and second opposite sides, said member having a substantial rigidity and being made of a resinous plastic material, said member having an opening therein extending between said opposite sides, an electrically conductive terminal rivet having a head portion on said first side of said terminal supporting member, said rivet having a shank portion connected to said head portion and extending through said opening in said member, a flexible laminated printed circuit having an aperture therein for receiving said shank portion of said rivet, said flexible printed circuit having an electrically insulating base lamina and an electrical conductor lamina securely laminated to said base lamina, said base lamina being made of a thin flexible resilient electrically insulating resinous plastic material, said electrical conductor lamina being made of thin flexible metal, said base lamina engaging said second side of said insulating terminal supporting member, and a compressible annular spring washer mounted on said shank portion of said rivet and engaging said electrical conductor lamina, said rivet having an upset end portion on said shank portion for securely engaging and retaining while also compressing said compressible spring washer, said washer being made of thin flexible resilient metal and being formed with a central annular dished portion, a reversely dished peripheral annular portion, and a smoothly rounded annular bulging portion therebetween for engaging said conductor lamina without any tendancy to cut into said conductor lamina, said washer being resiliently compressible to obviate any looseness of said terminal rivet despite any minor dimensional variations and despite any shrinkage of said flexible printed circuit and said terminal supporting member due to such factors as aging and temperature variations.

2. An electrical switch or the like according to claim 1, including an electrically conductive contactor movable selectively into and out of engagement with said head portion of said rivet.

3. An electrical switch or the like according to claim 1, including a thin electrical conductor secured between said electrically insulating terminal supporting member and said head portion of said rivet.

* * * * *